US005690040A

United States Patent [19]

Nakayama et al.

[11] Patent Number: 5,690,040

[45] Date of Patent: Nov. 25, 1997

[54] PRESSER FOOT DEVICE FOR FEEDING ELASTIC MEMBER

[75] Inventors: Koichi Nakayama; Shinji Kojima, both of Utsunomiya, Japan

[73] Assignee: The Singer Company N.V., Curaco, Netherlands Antilles

[21] Appl. No.: 659,211

[22] Filed: Jun. 5, 1996

[30] Foreign Application Priority Data

Jun. 7, 1995 [JP] Japan ..... 7-163118

[51] Int. Cl.[6] ..... D05B 29/08; D05B 35/06

[52] U.S. Cl. ..... 112/235; 112/152

[58] Field of Search ..... 112/132, 144, 112/145, 146, 152, 235, 236, 135

[56] References Cited

U.S. PATENT DOCUMENTS 929,686 8/1909 Moffatt ..... 112/135
1,731,074 10/1929 Maier ..... 112/152
4,909,165 3/1990 Bozoglou ..... 112/235 X
5,131,337 7/1992 Wang ..... 112/152

*Primary Examiner*—Ismael Izaguirre
*Attorney, Agent, or Firm*—McCormick, Paulding & Huber

[57] ABSTRACT

The presser foot device of a sewing machine comprises a presser foot 2, a tension mechanism 3 disposed on the presser foot 2 and having a presser member 6 which is adjustably movable back and forth, a guide member 4 provided at a tip end portion of the presser foot 2, wherein a given gap Δ is formed between the presser member 6 of the tension mechanism 3 and the guide member 4, and wherein a belt-shaped rubber member 8 supplied toward a needle penetration point N of the presser foot 2 is passed through the given gap Δ, thereby giving a given tension to the belt-shaped rubber member 8. As a result, it is possible to provide a presser foot device of a sewing machine capable of easily, stably and variably setting tension applied to a belt-shaped rubber member, thereby improving the quality of the sewn product and to improve the operability of mounting the belt-shaped rubber member therein by ensuring a large opening space.

5 Claims, 5 Drawing Sheets

PRESSER FOOT DEVICE FOR FEEDING ELASTIC MEMBER

BACKGROUND OF INVENTION

1. Field of the Invention

The present invention relates to a presser foot device of a sewing machine.

2. Prior Art

As a prior art presser foot device of a sewing machine, there is known a presser foot device, e.g., as disclosed in JP-U 62-109072. This presser foot device sews a rubber tape on a cloth to be sewn (referred to as a workpiece hereinafter) while giving a given tension to the rubber tape, thereby attaching pleats (gathers) to the workpiece. This presser foot device is used when the rubber tape is hemmed, and the rubber tape is sewn on cuffs of clothes, etc. That is, this presser foot device comprises a rubber tape pressing roller means provided separately at an end portion of a presser foot in such a manner as to be dosable relative to the presser foot, the end portion receiving the workpiece thereunder, and an outlet opening of which the rubber tape is disposed close to a needle penetration point. According to this presser foot device, the insertion setting of the rubber tape can be very easily performed by opening the separately provided roller means.

However, in such a prior art presser foot device of a sewing machine, the rubber tape is elastically clamped and pressed between a base portion disposed at the rear portion (rear portion in the feeding direction of the workpiece) of the presser foot be behind the outlet opening and the roller urged by a spring, thereby giving a given tension to the rubber tape passing therethrough. Accordingly, the tension of the rubber tape is largely influenced by repellent force of the spring and turning resistance of the roller, which causes such a problem that the tension of the rubber tape is unstable and the high quality pleats can not be formed. In addition, since the pressing force of the roller is adjusted by adjusting the repellent force of the spring, so as to adjust the tension applied to the rubber tape, it is difficult to largely change the tension applied to the rubber tape.

The outlet opening of the rubber tape is extended sidewardly relative to the presser foot, and the rubber tape pressing roller means is swung up forward to make a space above the outlet opening for inserting the rubber tape therein. Accordingly, there are such problems that disposing the outlet opening of the rubber tape adjacent to the needle penetration point cannot be sufficiently compatible with making a large space above fie outlet opening without being obstructed by the needle penetration point, and there is a limit in facilitating the insertion setting of the rubber tape from the rear portion thereof. Furthermore, since the rubber tape pressing means is swung up forward to make a space above the outlet opening, an additional means for holding the rubber tape pressing means at an upper portion is required, and the device becomes complicated in structure as a whole to be expensive in manufacturing cost.

SUMMARY OF THE INVENTION

The present invention has been made in view of the technical problems of the prior art presser foot device having the following arrangement.

A presser foot device of a sewing machine according to a first aspect of the invention comprises a presser foot 2, a tension mechanism 3 disposed on the presser foot 2 and having a presser member 6 which is adjustably movable back and forth, a guide member 4 provided at the tip end portion of the presser foot 2, wherein a given gap Δ is formed between the presser member 6 of the tension mechanism 3 and the guide member 4 and wherein a belt-shaped rubber member 8 supplied toward the needle penetration point N of the presser foot 2 is passed through the given gap Δ, thereby giving a given tension to the belt-shaped rubber member 8.

A presser foot device according to a second aspect of the invention is that of the first aspect of the invention, wherein the presser member 6 is disposed to clamp a nut member 7, the nut member 7 being screwed onto a screw member 5 which protrudes from the rear side surface of a supporting portion 2*a* of the presser foot 2 with respect to the cloth feeding direction, and the presser member 6 being adjusted back or forth by turning the nut member 7.

A presser foot device according to a third aspect of the invention is that of the second aspect of the invention, wherein the nut member 7 has a plurality of uneven portions 7*a*, and the presser member 6 has a protruding portion 6*e*, the protruding portion 6*e* elastically and detachably fitting in one of the uneven portions 7*a*.

A presser foot device according to a fourth aspect of the invention is that of the third aspect of the invention, wherein one end of the guide member 4 is swingably supported by an attaching portion 2*c* protruding from one side of the tip end of the presser foot 2 by way of a pin 9, and a convex retaining portion 4*c* formed at the other end of the guide member 4 can be retained by the concave retaining portion 2*d* of the presser foot 2 to form the given gap Δ between the presser member 6 of the tension mechanism 3 and the guide member 4.

A presser foot device according to a fifth aspect of the invention is that of the fourth aspect of the invention further including an elastic body 13 (wave washer) interposed between the protruding portion 4*a* of the guide member 4 and the head portion 9*c* of the pin 9 for elastically pressing the protruding portion 4*a* toward the attaching portion 2*c*, and wherein the seating face of the elastic body 13 of the protruding portion 4*a* is gradually inclined upward toward the side portion thereof up to an inclination angle α with respect to the horizontal line.

A presser foot device according to a sixth aspect of the invention is that of the 1st, 2nd, 3rd, 4th or 5 aspect of the invention, wherein an upper surface of a middle portion of the guide member 4 extending sidewardly forms a guide concave portion 4*d* which is open forwardly and backwardly, and wherein the belt-shaped rubber member 8 which is moved on the guide concave portion 4*d* is guided by the bottom surface 4*g* and the respective right and left guide surfaces 4*e* and 4*f* of the guide concave portion 4*d*, and wherein the bottom surface 4*g* of the guide concave portion 4*d* is gradually inclined downward toward the given gap Δ, and a plurality of inclined projecting ridges 16 are provided at one of confronting side surfaces of the presser member 6 and guide member 4 forming the given gap Δ for feeding the belt-shaped rubber member 8 toward one of right and left directions.

According to the first aspect of the invention, the belt-shaped rubber member 8, which is set on the presser foot device, is fed in the cloth feeding direction together with a workpiece 14 by the operation of the cloth feeding mechanism when the sewing machine is driven, and the belt-shaped rubber member 8 reaches a needle penetration point N to be sewn where the needle is vertically moved. When the belt-shaped rubber member 8 passes through the given gap Δ between the presser member 6 of the tension mechanism 3 and the guide member 4, a given frictional resistance and also a given tension are given thereto. Since the tension of the belt-shaped rubber member 8 is maintained until it reaches the needle penetration point N while it is pressed by the presser foot 2, the belt-shaped rubber member 8 is sewn on the workpiece 14 while it is extended elastically. Accordingly, pleats (gathers) of the workpiece 14 are formed after the sewing operation due to the elastic contraction of the belt-shaped rubber member 8.

According to the second aspect of the invention, the adjustment of the given gap Δ is performed as follows. That is, the nut member 7 is manually turned normally or reversely so as to adjustably move the presser member 6 back or forth. As a result, the given gap Δ between the presser member 6 and the guide member 4 can be appropriately set depending on the kinds, thickness etc., of the belt-shaped rubber member 8.

According to the third aspect of the invention, when the nut member 7 is manually turned normally or reversely, the protruding portion **6*e* successively gets over the convex portions of the uneven portions 7*a*, until it fits in a target concave portion of the uneven portions 7*a*, so that the nut member 7** is elastically held at a given turning position.

According to the fourth aspect of the invention, when the belt-shaped rubber member 8 is set on the presser foot device, the convex retaining portion **4*c* of the guide member 4 is released from the concave retaining portion 2*d* of the presser foot 2 so as to turn the guide member 4 about the pin 9; thereby largely opening the guide member 4 to make a large space behind the rear portion 6*a* of the presser member 6**.

The belt-shaped rubber member 8 can be easily set on the lower surface of the presser foot 2 in a state where the large space behind the rear portion of the presser member 6 is secured. Successively, the guide member 4 is reversely turned about the pin 9 so that the convex retaining portion **4*c* is retained by the concave retaining portion 2*d* to close the guide member 4, thereby forming the given gap Δ between the guide member 4 and the presser member 6**.

According to the fifth aspect of the invention, the elastic body 13 is slightly compressed and deformed when the guide member 4 is opened or closed. Whereupon, the seating face of the protruding portion **4*a* is gradually inclined upward toward the side portion thereof up to the inclination angle α with respect to the horizontal line. As a result, the elastic body 13 is restrained from being largely compressed and deformed locally following the lifting operation of the guide member 4, thereby restraining earlier settling of the elastic body 13**.

According to the sixth aspect of the invention, since the belt-shaped rubber member 8 is received by the guide concave portion **4*d* and is guided by the bottom surface 4*g* and the left and right guide surfaces 4*e* and 4*f* of the guide concave portion 4*d* when it is fed to the presser foot device, it is hardly bent. Further, since the bottom surface 4*g* of the guide concave portion 4*d* is gradually inclined downward in the cloth feeding direction A, the belt-shaped rubber member 8 is smoothly fed toward the given gap Δ so that the variation of the tension to be given to the belt-shaped rubber member 8 is restrained. Still further, the belt-shaped rubber member 8 passing through the given Δ contact the inclined projecting ridges 16 and is fed toward one side of the right and left directions and is maintained at a given position with respect to the presser foot 2, so that the belt-shaped rubber member 8** is better restrained from being bent.

PREFERRED EMBODIMENT OF THE INVENTION

A presser foot device according to a preferred embodiment of the present invention will be now described with reference to FIGS. 1 through 8.

FIGS. 1 through 8 show an embodiment wherein the present invention is applied to a presser foot device of an overlock sewing machine.

Figure 1:
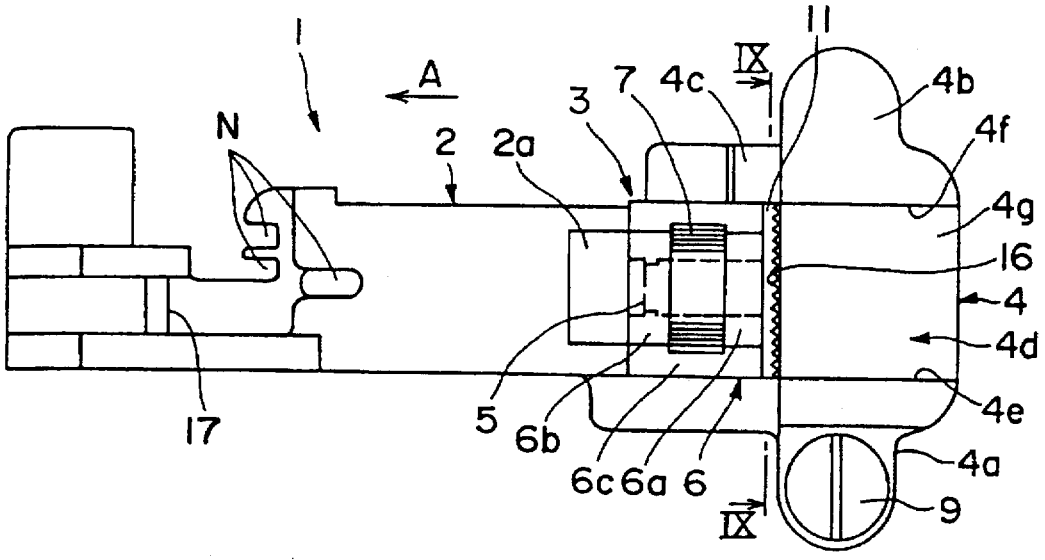
FIG. 1 is a plan view of a presser foot device of a sewing machine according to a preferred embodiment of the invention.
Figure 2:
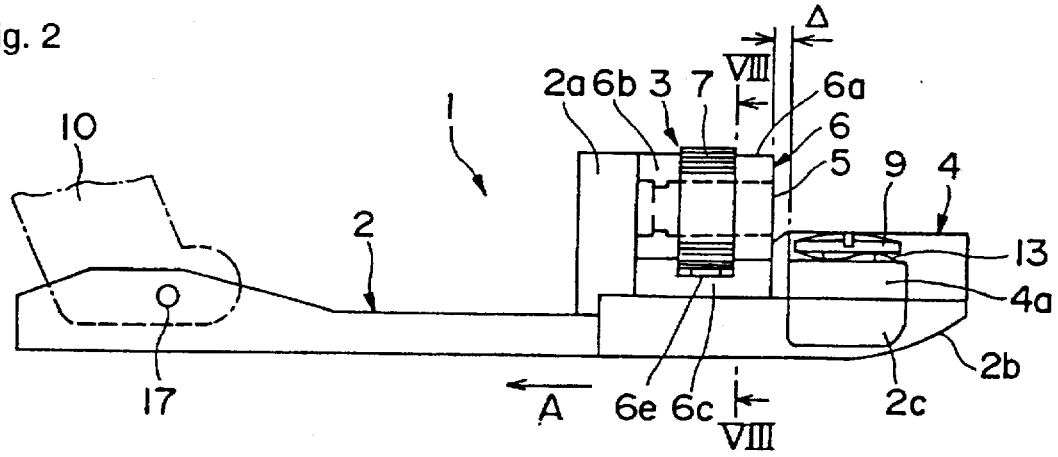
FIG. 2 is a right side view of the presser foot device of FIG. 1.
Figure 7:
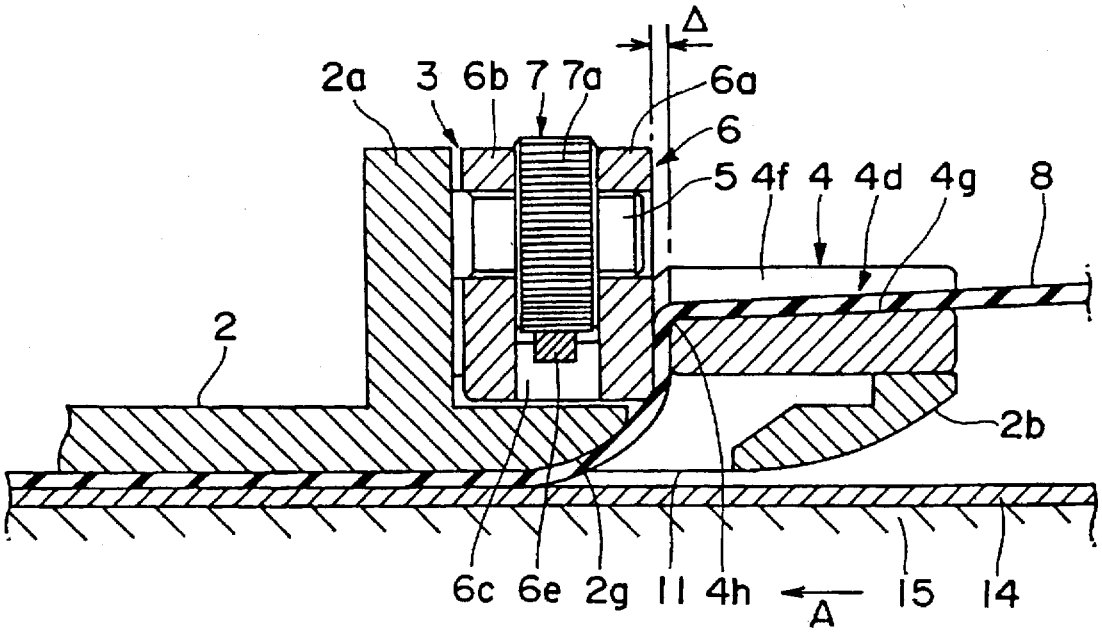
FIG. 7 is a cross sectional view showing an essential portion of FIG. 1.

A presser foot device 1 comprises a presser foot 2, a tension mechanism 3 and a guide member 4. The presser foot 2 is supported by the lower end portion of a presser bar 10 at the base portion thereof by way of a hinge pin 17 so as to be vertically swingable as shown in FIG. 2. The presser foot 2 has a needle penetration point N formed at the middle portion thereof, a supporting portion **2*a* protruding from the upper surface thereof dose to the tip end (rear end in a cloth feeding direction A), and an opening 11 defined at the tip end portion thereof. The opening 11 extends to the fight and left to form a rectangular shape. The presser foot 2 connected to the rear end of the opening 11 in the cloth feeding direction A has s curved guide surface 2*b* at the lower surface thereof as shown in FIG. 7. The guide surface portion 2*b* aides a workpiece 14 (see FIG. 7), and a curved guide surface portion 2*g* which is connected to the front end of the opening 11 and is formed at the lower surface of the presser foot 2 guides a belt-shaped rubber member 8**, described later, so that the belt-shaped rubber member can move smoothly.

Figure 8:
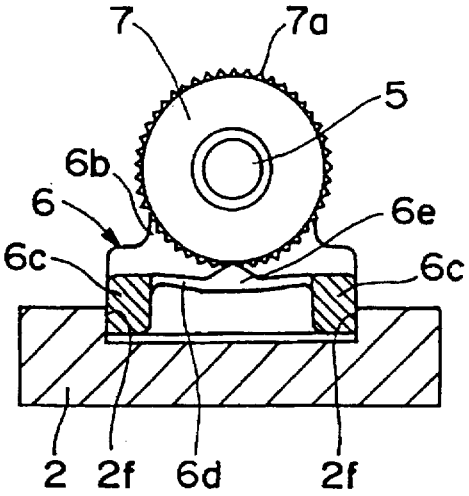
FIG. 8 is a cross sectional view taken along line VIII—VIII in FIG. 2.

The tension mechanism 3 comprises a screw member 5, which protrudes horizontally from the rear side surface of the supporting portion **2*a* in the cloth feeding direction, a presser member 6 and a nut member 7 to be screwed into the screw member 5. The presser member is formed of a short cylindrical rear portion 6*a*, a short cylindrical front portion 6*b*, and a coupling portion 6*c* for coupling the fight and left sides of the rear and front portions 6*a* and 6*b* at the lower ends thereof wherein the rear and front portions 6*a* and 6*b* are movably engaged with the screw member 5. The nut member 7 is rotatably clamped between the rear and front portions 6*a* and 6*b* generating a gap therebetween as little as possible. As shown in FIG. 8, the outer periphery of the nut member 7 except the lower portion thereof slightly protrudes from the rear and front portions 6a and 6b. A plurality of uneven portions 7a extending in a direction of the central axis of the nut member 7 are formed on the entire outer periphery of the nut member 7 so as to form saw teeth. As shown in FIG. 8, a protruding portion 6e of a retaining member 6d bridging over the left and right coupling portions 6c detachably fits in the uneven portions 7a. The retaining member 6d is made of a spring member to be elastically deformable in order to allow the protruding portion 6e to fits in the uneven portions 7a by turning the nut member 7**.

Since the protruding portion 6e sequentially gets over the convex portions of the uneven portions 7a and fits in a target concave portion by manually turning the nut member 7. It is possible to elastically hold the nut member 7 at a given turning position and prevent the same from idle turning. At the same time, the presser member 6 is adjusted back and forth by turning the nut member 7. Since the coupling portion 6c of the presser member 6 are retained at both side surfaces of the lower end thereof by a pair of right and left step surfaces 2f extending in the back and forth directions of the presser foot 2 as shown in FIG. 8, the presser member 6 is not turned together with the nut member 7 when the nut member 7 is turned.

Figure 3:
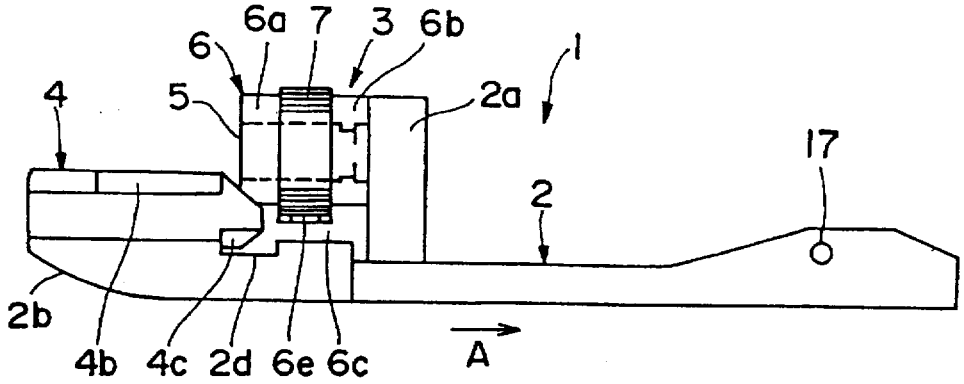
FIG. 3 is a left side view of the presser foot device of FIG. 1.
Figure 4:
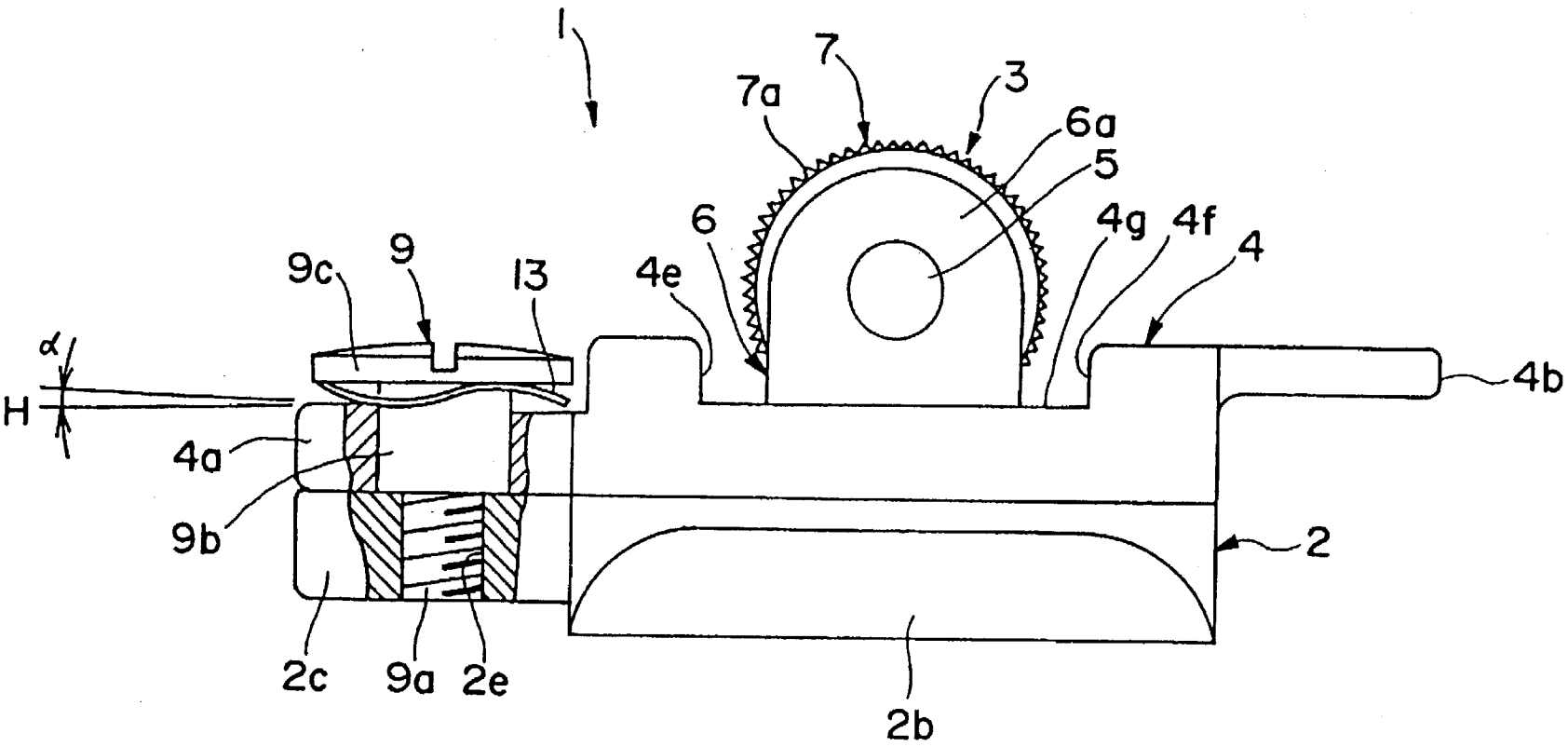
FIG. 4 is an enlarged partly cut away rear view of the presser foot device of FIG. 1.

The guide member 4 has a protruding portion at one end thereof which is swingably supported by an attaching portion 2c protruding from the tip end portion of the presser foot 2 in a lateral direction (downward in FIG. 5) by way of a pin 9. The pin 9 has a male screw at a small diameter portion 9a at the tip end thereof, and the small diameter portion 9a is screwed into and attached to the female screw 2e of the attaching portion 2c. The large diameter portion 9b penetrates a through hole of the protruding portion 4a of the guide member 4, and an elastic wave washer 13 (elastic body) is interposed between the head portion 9c of the pin 9 and the seating face formed by the upper surface of the protruding portion 4a. The seating face of the protruding portion 4a is gradually inclined upward toward the side portion thereof (leftward in FIG. 4) up to an inclination angle a with respect to a horizontal line H. The other end of the 8 guide member has a holding portion 4b protruding sidewards and a convex retaining portion 4c formed on the lower surface of the other end thereof as shown in FIG. 3. Further, the guide member 4 has a guide concave portion 4d on the upper surface of the middle portion thereof. Guide surfaces 4e and 4f provided at right and left sides of the bottom surface 4g of the guide concave portion 4d, which is open forwardly and backwardly are disposed apart from each other substantially as far as the width of the belt-shaped rubber member 8 as shown in FIG. 7, and they guide the both side surfaces of the belt-shaped rubber member 8 which moves on the bottom surface 4g of the guide concave portion 4d. The belt-shaped rubber member 8 is a rubber tape, flat rubber, a rubber belt, etc., a main material of which is rubber or elastomer.

When the convex retaining portion 4c of the guide member 4 is retained in the concave retaining portion 2d formed on the presser foot 2 as shown in FIG. 3 to restrict the guide member 4 from moving backward, a given Δ is formed between the front end surface of the bottom surface 4g of the guide member 4 and the rear surface of the presser member 6 (rear surface of the rear portion 6a) confronting the bottom surface 4g. The given gap Δ has a function to apply a given frictional resistance to the belt-shaped rubber member 8 fed thereto and a given tension to the belt-shaped rubber member 8 which passes therethrough to reach the needle penetration point N. The right and left ends of the given Δ are defined by both side walls of the opening 11 of the presser foot 2.

Figure 9:
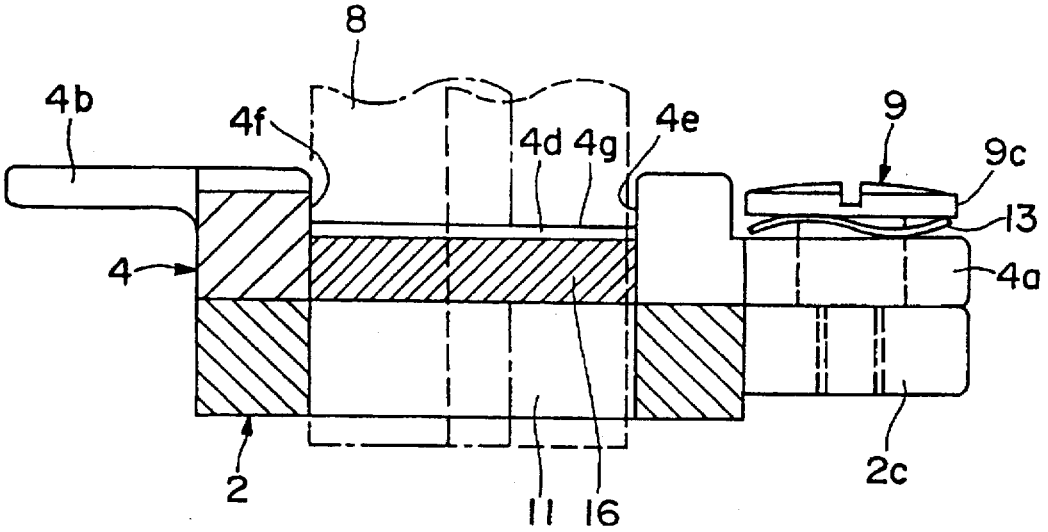
FIG. 9 is a cross sectional view taken along line IX—IX in FIG. 2.

Accordingly, the bottom surface 4g of the guide concave portion 4d is gradually inclined downward in the cloth feeding direction A, i.e., toward the given Δ to form an acute angle between the front end portion of the bottom surface 4g and the rear surface of the presser member 6 confronting the bottom surface 4g. Further, there is provided a chamfered corner 4h at the front end of the bottom surface 4g as shown in FIG. 7. In this way, it is designed so that the belt-shaped rubber member 8 can be supplied stably from the guide concave portion 4d toward the given Δ. Further, a plurality of projecting ridges 16 are formed in such a manner that they are inclined at a given angle in parallel with one another on the side surface of the guide member 4 which defines the given Δ, i.e., on the front end surface thereof connected to the chamfered comer 4h for feeding the passing belt-shaped rubber member 8 to one side as shown in FIG. 9. The projecting ridges 16 have a function to contact the belt-shaped rubber member 8 which passes through the given Δ and feed it to one of the right and left directions (leftward in FIG. 9), so as to locate the belt-shaped rubber member 8 at a given position corresponding to the needle penetration point N. It is also possible to form the projecting ridges 16 on the side surface of the presser member 6 confronting the guide member 4.

The operation of the presser foot device of the present invention will be now described.

Figure 5:
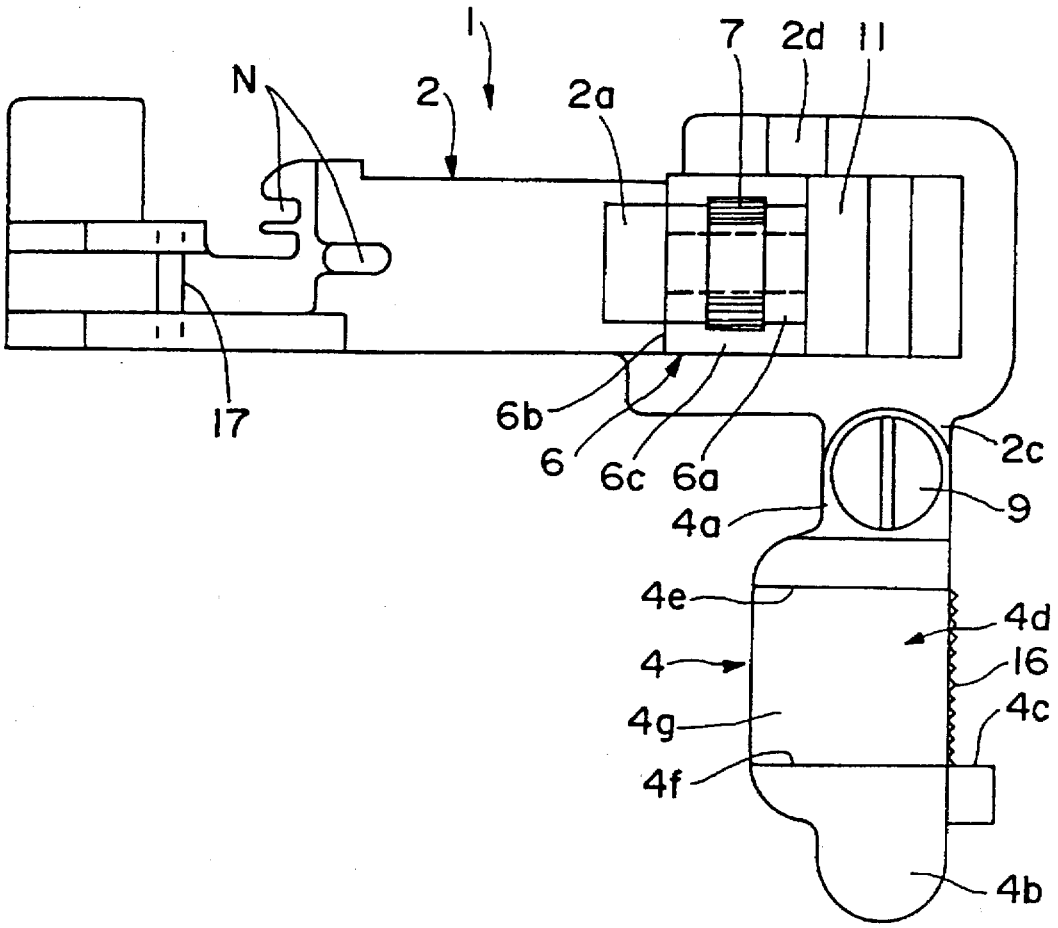
FIG. 5 is a view showing the operation of the presser foot device of FIG. 1.
Figure 6:
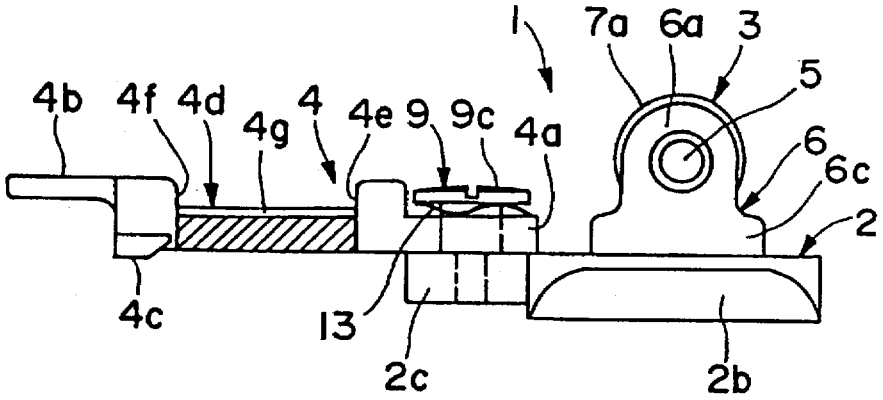
FIG. 6 is a view showing the operation of the presser foot device of FIG. 1.

When the belt-shaped rubber member 8 is set to the presser foot device 1, the convex retaining portion 4c of the 8 guide member 4 is released from the concave retaining portion 2d of the presser foot 2, so as to largely open the guide member 4, thereby making a large space behind the rear portion 6a of the presser member 6 as shown in FIG. 5. That is, the convex retaining portion 4c is released from the concave retaining portion 2d and the guide member 4 is turned (clockwise in FIG. 1) about the pin 9 by slightly lifting the guide member 4 while holding the holding portion 4b. When the guide member 4 is lifted while holding the holding portion 4b, the wave washer 13 is slightly compressed and deformed.

In this way, making a large space behind the rear portion of the presser member 6, i.e., above the opening 11, facilitates setting the belt-shaped rubber member 8. That is, the tip end of the belt-shaped rubber member 8 is inserted through the opening 11 of the presser foot 2, and is drawn forward under the presser foot 2 to a position close to the needle penetration point N as shown in FIG. 7. Successively, the guide member 4 is turned reversely about the pin 9 while holding the holding portion 4b, and the guide member 4 is closed at the lower portion of the belt-shaped rubber member 8. At this time the guide member 4 is slightly lifted so that the convex retaining portion 4c is retained by the concave retaining portion 2d. When the guide member 4 is opened or closed, the wave washer 13 is slightly compressed and deformed. When the guide member 4 is lifted while holding the holding portion 4b to compress and deform the wave washer 13, since the seating face of the protruding portion 4a is gradually inclined upward toward the side portion thereof up to an inclination angle a with respect to the horizontal line H, the wave washer 13 is liable to be uniformly compressed and deformed. As a result, the wave washer 18 is restrained from being largely compressed and deformed locally, so that the settling of the wave washer 13 is restrained. When the guide member 4 is closed, the belt-shaped rubber member 8 is placed on the guide concave portion 4d.

Thereafter the given gap Δ is set appropriately. That is, the nut member 7 is manually turned normally or reversely so as to adjust the presser member 6 forward or backward. In such a manner, the given Δ is set between the front surface of the guide concave portion 4*d* and the rear surface of the rear portion 6*a* of the presser member 6 confronting the guide concave portion 4*d* depending on the kinds and thickness, etc., of the belt-shaped rubber member 8. When the nut member 7 is turned, the protruding portion 6*e* sequentially gets over the ridges of the uneven portions 7*a* until it fits in a target concave portion of the uneven portions 7*a*, so as to elastically hold the nut member 7 at a given turning position. The setting operation of the given gap Δ may be performed only when the belt-shaped rubber member 8 is replaced by that which is different in the kinds, the thickness, etc., but it is not necessary when the belt-shaped rubber member 8 is consumed and replaced by another one.

When the given gap Δ is appropriately set, the sewing operation is started. In the sewing operation, a workpiece 14 is inserted under the presser foot 2 and the belt-shaped rubber member 8 as shown in FIG. 7, and is clamped between the presser foot 2 and the throat plate 15 in a state where the workpiece 14 and the belt-shaped rubber member 8 are laid on each other. When the sewing machine is driven, the workpiece 14 and the belt-shaped rubber member 8 are successively fed forward in a cloth feeding direction A by the operation of a both feeding mechanism, not shown, so that the workpiece 14 and the belt-shaped rubber member 8 reach the needle penetration point N to be sewn, where a needle, not shown, moves vertically. When the belt-shaped rubber member 8 passes through the given gap Δ, a given frictional resistance is given to the belt-shaped rubber member 8 by the front end surface connecting to the bottom surface 4*g* of the guide member 4 and the rear surface of the rear portion 6*a* of the presser member 6, and hence a given tension is given thereto. Since the tension of the belt-shaped rubber member 8 pressed by the presser foot 2 is maintained until the belt-shaped rubber member 8 reaches the needle penetration point N, the belt-shaped rubber member 8 is sewn to the workpiece 14 in a state where it is extended elastically. Whereupon, pleats (gather) of the sewn workpiece 14, which has passed under the presser foot 2, is formed due to the elastic contraction of the belt-shaped rubber member 8.

Figure 10:
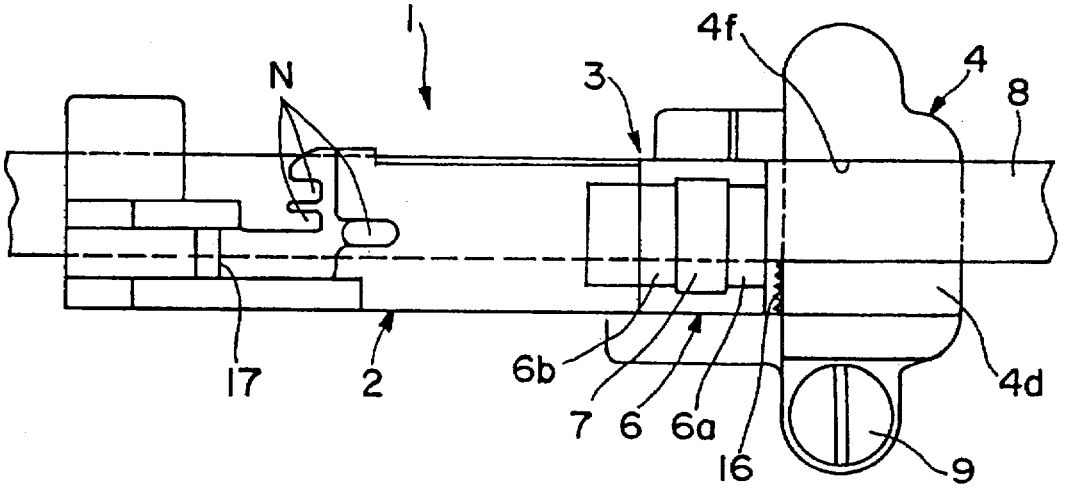
FIG. 10 is a view showing the operation of the presser foot device of FIG. 1.

When the belt-shaped rubber member 8 is fed, it is received by the guide concave portion 4*d* and is guided by the guide surfaces 4*e* end 4*f* at right and left both sides thereof so that the belt-shaped rubber member 8 is hardly bent. Further, since the bottom surface 4*g* of the guide concave portion 4*d* is gradually downwardly inclined in the cloth feeding direction A, the belt-shaped rubber member 8 is smoothly fed toward the given gap Δ, and the variation (increasing or decreasing) of tension applied to the belt-shaped rubber member 8 is restrained. Still further, the belt-shaped rubber member 8 which passes through the given gap Δ contacts a plurality of inclined projecting ridges 16 to be fed to one side corresponding to the needle penetration point N as shown in FIG. 10, and always slidably contacts the right side guide surface 4*f* as viewed from the rear side with respect to the cloth feeding direction A (or the side wall of the opening 11 at the side of the needle penetration point N), so that the belt-shaped rubber member 8 can be held at given position with respect to the presser foot 2 even if it has a width narrower than the lateral width of the bottom surface 4*g* of the guide concave portion 4*d* (interval between the guide surfaces 4*e* and 4*f*). It is needless to say that the initial setting position of the belt-shaped rubber member 8 should be close to the side guide surface 4*f*.

As is understood from the above explanation, the following effects can be obtained.

(1) Since a given tension is applied to the belt-shaped rubber member while the belt-shaped rubber member is passed through a given gap, the tension applied to the belt-shaped rubber member can be stably set compared with the conventional presser foot device wherein a given tension is applied to the rubber tape by elastically clamping the same between rollers which are urged by the springs and a base plate as the rubber tape passes therebetween. As a result, an accurate tension is applied to the belt-shaped rubber member by a device having a simple structure so as to sew the belt-shaped rubber member on the workpiece, thereby improving the quality of the sewn product.

(2) Further, since the tension mechanism disposed on the presser foot is not opened or closed so that it hardly interferes with the needle penetration point, the given gap which applies a given tension to the belt-shaped rubber member can be disposed to a position close to the needle penetration point, thereby preventing the belt-shaped rubber member, which has passed through the given gap, from getting out of position. As a result, the belt-shaped rubber member can be sewn to the workpiece at the accurate position thereof, leading to the improvement of the quality of the sewn product.

(3) According to the second a aspect of the invention, since the presser member is adjusted forward or backward by rotating the nut member so as to form a given gap between the presser member of the tension mechanism and the guide member and a given tension is applied to the belt-shaped rubber member while the belt-shaped rubber member passes through the given gap, the tension applied to the belt-shaped rubber member can be easily and stably changed. Further, it is also possible to largely charge the tension applied to the belt-shaped rubber member. Accordingly, the belt-shaped rubber member can be sewn to the workpiece while applying an accurate tension thereto, thereby improving the quality of the sewn product. Still further, since the mounting operation of the belt-shaped rubber member can be performed while the nut member and further the presser member are kept at a given position, the tension setting operation by the presser member is not needed every time the mounting operation is performed following the replacement of the belt-shaped rubber member of same kind, so that it is excellent in the workability of replacing the belt-shaped rubber member.

(4) According to the third aspect of the invention, since the convex portion of the retaining member engages with the concave portions of the uneven portions of the nut member to regulate the same in turning, the nut member is excellent in feeling at the time of adjustment and the change of tension applied to the belt-shaped rubber member owing to the idle turning of the nut member is prevented. As a result, it is possible to prevent the belt-shaped rubber member from being sewn to the workpiece nonuniformly due to the change of the tension applied thereto, so that high quality pleats can be attached to the sewn product.

(5) According to the fourth aspect of the invention, since the belt-shaped rubber member can be mounted while the guide member is turned about the pin so as to make a large space in front of the presser foot, the large opening can be assured, leading to the excellent working performance. Still further, since the convex retaining portion of the guide member is retained in the concave retaining portion of the presser foot, the belt-shaped rubber member can be easily mounted by merely turning the guide member and the given from the rear and front portions 6a and 6b. A plurality of uneven portions 7a extending in a direction of the central axis of the nut member 7 are formed on the entire outer periphery of the nut member 7 so as to form saw teeth. As shown in FIG. 8, a protruding portion 6e of a retaining member 6d bridging over the left and right coupling portions 6c detachably fits in the uneven portions 7a. The retaining member 6d is made of a spring member to be elastically deformable in order to allow the protruding portion 6e to fits in the uneven portions 7a by turning the nut member 7.

Since the protruding portion 6e sequentially gets over the convex portions of the uneven portions 7a and fits in a target concave portion by manually turning the nut member 7. It is possible to elastically hold the nut member 7 at a given turning position and prevent the same from idle turning. At the same time, the presser member 6 is adjusted back and forth by turning the nut member 7. Since the coupling portion 6c of the presser member 6 are retained at both side surfaces of the lower end thereof by a pair of right and left step surfaces 2f extending in the back and forth directions of the presser foot 2 as shown in FIG. 8, the presser member 6 is not turned together with the nut member 7 when the nut member 7 is turned.

The guide member 4 has a protruding portion at one end thereof which is swingably supported by an attaching portion 2c protruding from the tip end portion of the presser foot 2 in a lateral direction (downward in FIG. 5) by way of a pin 9. The pin 9 has a male screw at a small diameter portion 9a at the tip end thereof, and the small diameter portion 9a is screwed into and attached to the female screw 2e of the attaching portion 2c. The large diameter portion 9b penetrates a through hole of the protruding portion 4a of the guide member 4, and an elastic wave washer 13 (elastic body) is interposed between the head portion 9c of the pin 9 and the seating face formed by the upper surface of the protruding portion 4a. The seating face of the protruding portion 4a is gradually inclined upward toward the side portion thereof (leftward in FIG. 4) up to an inclination angle a with respect to a horizontal line H. The other end of the 8 guide member has a holding portion 4b protruding sidewards and a convex retaining portion 4c formed on the lower surface of the other end thereof as shown in FIG. 3. Further, the guide member 4 has a guide concave portion 4d on the upper surface of the middle portion thereof. Guide surfaces 4e and 4f provided at right and left sides of the bottom surface 4g of the guide concave portion 4d, which is open forwardly and backwardly are disposed apart from each other substantially as far as the width of the belt-shaped rubber member 8 as shown in FIG. 7, and they guide the both side surfaces of the belt-shaped rubber member 8 which moves on the bottom surface 4g of the guide concave portion 4d. The belt-shaped rubber member 8 is a rubber tape, flat rubber, a rubber belt, etc., a main material of which is rubber or elastomer.

When the convex retaining portion 4c of the guide member 4 is retained in the concave retaining portion 2d formed on the presser foot 2 as shown in FIG. 3 to restrict the guide member 4 from moving backward, a given Δ is formed between the front end surface of the bottom surface 4g of the guide member 4 and the rear surface of the presser member 6 (rear surface of the rear portion 6a) confronting the bottom surface 4g. The given gap Δ has a function to apply a given frictional resistance to the belt-shaped rubber member 8 fed thereto and a given tension to the belt-shaped rubber member 8 which passes therethrough to reach the needle penetration point N. The right and left ends of the given Δ are defined by both side walls of the opening 11 of the presser foot 2.

Accordingly, the bottom surface 4g of the guide concave portion 4d is gradually inclined downward in the cloth feeding direction A, i.e., toward the given Δ to form an acute angle between the front end portion of the bottom surface 4g and the rear surface of the presser member 6 confronting the bottom surface 4g. Further, there is provided a chamfered corner 4h at the front end of the bottom surface 4g as shown in FIG. 7. In this way, it is designed so that the belt-shaped rubber member 8 can be supplied stably from the guide concave portion 4d toward the given Δ. Further, a plurality of projecting ridges 16 are formed in such a manner that they are inclined at a given angle in parallel with one another on the side surface of the guide member 4 which defines the given Δ, i.e., on the front end surface thereof connected to the chamfered comer 4h for feeding the passing belt-shaped rubber member 8 to one side as shown in FIG. 9. The projecting ridges 16 have a function to contact the belt-shaped rubber member 8 which passes through the given Δ and feed it to one of the right and left directions (leftward in FIG. 9), so as to locate the belt-shaped rubber member 8 at a given position corresponding to the needle penetration point N. It is also possible to form the projecting ridges 16 on the side surface of the presser member 6 confronting the guide member 4.

The operation of the presser foot device of the present invention will be now described.

When the belt-shaped rubber member 8 is set to the presser foot device 1, the convex retaining portion 4c of the 8 guide member 4 is released from the concave retaining portion 2d of the presser foot 2, so as to largely open the guide member 4, thereby making a large space behind the rear portion 6a of the presser member 6 as shown in FIG. 5. That is, the convex retaining portion 4c is released from the concave retaining portion 2d and the guide member 4 is turned (clockwise in FIG. 1) about the pin 9 by slightly lifting the guide member 4 while holding the holding portion 4b. When the guide member 4 is lifted while holding the holding portion 4b, the wave washer 13 is slightly compressed and deformed.

In this way, making a large space behind the rear portion of the presser member 6, i.e., above the opening 11, facilitates setting the belt-shaped rubber member 8. That is, the tip end of the belt-shaped rubber member 8 is inserted through the opening 11 of the presser foot 2, and is drawn forward under the presser foot 2 to a position close to the needle penetration point N as shown in FIG. 7. Successively, the guide member 4 is turned reversely about the pin 9 while holding the holding portion 4b, and the guide member 4 is closed at the lower portion of the belt-shaped rubber member 8. At this time the guide member 4 is slightly lifted so that the convex retaining portion 4c is retained by the concave retaining portion 2d. When the guide member 4 is opened or closed, the wave washer 13 is slightly compressed and deformed. When the guide member 4 is lifted while holding the holding portion 4b to compress and deform the wave washer 13, since the seating face of the protruding portion 4a is gradually inclined upward toward the side portion thereof up to an inclination angle a with respect to the horizontal line H, the wave washer 13 is liable to be uniformly compressed and deformed. As a result, the wave washer 18 is restrained from being largely compressed and deformed locally, so that the settling of the wave washer 13 is restrained. When the guide member 4 is closed, the belt-shaped rubber member 8 is placed on the guide concave portion 4d.

Thereafter the given gap Δ is set appropriately. That is, the nut member 7 is manually turned normally or reversely so as